United States Patent [19]

Barozzi et al.

[11] 4,332,491

[45] Jun. 1, 1982

[54] DEVICE FOR THE FEED AND MOTION REVERSAL OF THE RIBBON FOR TYPEWRITER CARTRIDGES AND CARTRIDGE THEREFORE

[75] Inventors: Gian P. Barozzi; Giancarlo Horeschi, both of Tokyo, Japan

[73] Assignee: Xelavis S.A., Panama City, Panama

[21] Appl. No.: 168,463

[22] Filed: Jul. 10, 1980

[30] Foreign Application Priority Data

Jul. 25, 1979 [IT] Italy ..... 24667 A/79

[51] Int. Cl.[3] ..... B41J 35/28; B41J 33/50

[52] U.S. Cl. ..... 400/208; 400/219.5; 400/220.1

[58] Field of Search ..... 400/219.5, 208, 220.1

[56] References Cited

U.S. PATENT DOCUMENTS 2,902,136 9/1959 Whippo ..... 400/219.5

3,513,957 5/1970 Ricciardi et al. ..... 400/219.5 X

*Primary Examiner*—Paul T. Sewell

*Attorney, Agent, or Firm*—Karl F. Ross

[57] ABSTRACT

A ribbon-feed and motion-reversal device for typewriters and the like comprises an oscillating supporting plate on which a cartridge with the spools carrying the inked ribbon is placed, the supporting plate being coupled to a driving lever driven by a cam mounted on the driving shaft of the typewriter, and suitable to transmit the winding action directly to either one of the ribbon-carrying spools of the cartridge. A balance lever is driven by the ribbon at the end of its unwinding, through oscillating wings on the cartridge.

4 Claims, 4 Drawing Figures

DEVICE FOR THE FEED AND MOTION REVERSAL OF THE RIBBON FOR TYPEWRITER CARTRIDGES AND CARTRIDGE THEREFORE

FIELD OF THE INVENTION

The present invention relates to a device for the feed and the motion reversal of an inked ribbon housed in a two-spool cartridge or like device. More particularly the invention relates to a system wherein the cartridge is inserted in a typewriter or like printing machine so that the ribbon finds itself between said type-carrying element of the typewriter and the platen, in the printing position.

The device for the feed and reverse motion of the ribbon, according to the present invention comprises a single element which acts directly on both spools to drive alternatively either one of the two spools, and also a single element that provides for reversal of the rotation of the spools and prevents the return of the winding spool, caused by the tension of the same ribbon, such element being associated with a suitable cartridge housing the spools.

BACKGROUND OF THE INVENTION

Various devices for the feed and reversal of motion of the ribbon of typewriters and like machines are known, in which the ribbon is housed in a cartridge or like container, which is mounted on the typewriter or replaced with certain operations involving insertion of the whole cartridge in to a suitable housing.

In the known devices usually some toothed means are provided, hinged on the typewriter frame, and engaged in rotation with the ribbon spools during the insertion of the cartridge in the same typewriter.

The means drive forward the two spools, while the control of the reversal of the direction of motion is obtained by means of feelers which monitor continuously the amount of ribbon which is wound on a spool and, at the right moment, provide the reversal action.

Said devices present at least two groups of disadvantages, one resulting from the complexity of construction, which requires, for the movement, toothed wheels for each spool, dog clutches and related supports, pivots and the like, with high production costs and difficulty of maintenance. The other group of disadvantages is related to the very mounting of the cartridge, since it is necessary that the feelers sensing the amount of ribbon wound on a spool be inserted in the cartridge and extracted from it when the cartridge is mounted on, or extracted from the typewriter, so that it becomes necessary to provide a supplementary mechanism which allows to preset, automatically or by manual operation, such sensing means in the cartridge.

OBJECT OF THE INVENTION

The present invention sets out to eliminate or, in any case, reduce quite notably, the aforesaid drawbacks by providing such a device in which the feeding of the ribbon is operated by means which operate directly on the spools of the cartridge, while the aforementioned feelers with the relative insertion devices have been eliminated, allowing a quick and automatic insertion and extraction of the cartridge into or out of the typewriter.

SUMMARY OF THE INVENTION

This object, according to one aspect of the invention is achieved by a device for the feed and motion reversal of the ribbon and the spools carrying the ribbon for typewriters and like machines, which comprises an oscillating support plate on which the cartridge with the spools carrying the ribbon is placed. This support plate is coupled to a driving lever driven by a cam rigidly mounted on the driving shaft of the machine and suitable to transmit the winding action directly to either one of the ribbon-carrying spools, and a lever with balance movement, suitable to be moved by the ribbon at the end of each unwinding. This movement is transmitted to the lever by means of oscillating wings on the cartridge for the motion reversal of said ribbon. An intermediate lever has a tooth, acting as stop preventing the return of the spool being wound, when said driving lever shifts from one tooth to the next, of said winding spool. A ring fastened to the extremities of the ribbon to actuate one of the ends of said oscillating wings which in connection with the balance lever to effect the reversal of winding of said ribbon.

The invention provides in the typewriter, and associated with its frame, a plate supporting the cartridge, on which plate the movement and reversal mechanisms are placed. The plate comprises substantially two levers one of which, driven directly by a cam mounted on the typewriter drive shaft, actuates either one of the two spools, by means of a projection entering the cartridge.

The spools are fitted with sawtooth gears, and the other lever provides the shifting of the direct control of the first lever from one spool to the other following a signal from the same ribbon, fitted at its ends with the small ring commonly known and applied in typewriters.

Said second lever provides furthermore a stop preventing the return of the spool driven in the winding motion by said first lever, so that the spool is withheld during the shifting of the stepping action from one tooth to the next.

According to the present invention the plate supporting the cartridge with the relative feed and reversal mechanisms, is connected in oscillatory way to the frame of the typewriter and is raised and lowered at each stroke, by means of its own projection in contact with a suitable cam of the driving shaft, so that the ribbon is brought into printing position for the stroke and it is lowered after the typeface has struck.

Furthermore the cartridge housing the two spools is an integral part of the device mentioned, since it is provided that elements of the same operate in association with the plate mechanism, both for the feed of the ribbon, and for the reversal of motion, the possibility existing also of replacement of the ribbon without having to perform any special operation besides the usual ones of inserting a new spool on its pivot and the feeding the ribbon through the opposite guides and fastening it to the empty spool.

The cartridge, according to the invention, can be also used and replaced as a whole, both in the case of change of color, as well as in the case of wear.

BRIEF DESCRIPTION OF THE DRAWINGS

These and other characteristics will appear evident from the following detailed description of a device for the feed and motion reversal, with a ribbon cartridge for typewriters and like devices, according to the invention, given as an example and illustrated in the attached drawing in which.

SPECIFIC DESCRIPTION

Figure 1:
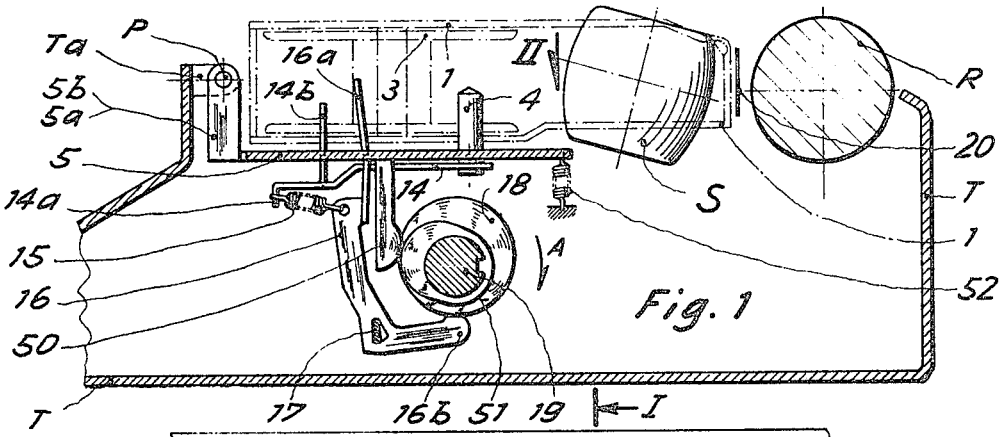
FIG. 1 is a side view taken along the line I—I of FIG. 2 of the device and ribbon cartridge showing some parts typical of a typewriter.
Figure 2:
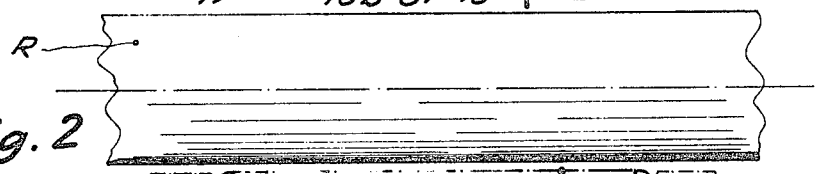
FIG. 2 is a top view in the direction of the arrow II of the device of FIG. 1 in which the cartridge with its spools and ribbon are shown in dot-dash lines and the parts of the device are indicated by solid or dashed lines.

FIGS. 1 and 2 show a typewriter in which a frame T, a platen R and a spherical type-carrying element S are indicated, the latter being suitable to be positioned with the selected character confronting the platen R.

A support plate 5 is hinged on projections Ta of the frame T of the typewriter, and oscillates about the axis defined by the pivots P, and is fitted with projections 5*a*–5*b* pointing upwards and spaced so as to come in contact with the projections Ta and be pivotally mounted on the pivots P.

Said oscillating support plate 5 has underneath a projection 50 (FIG. 1) which, with its extremity, rides on a cam 51 rotating with the driving shaft 19 of the typewriter, which shall be mentioned below.

A spring 52 connects the oscillating support 5 with a fixed part of the frame T so that, during the rotation of the cam 51, the support 5 is raised oscillating around the pivots P, and then lowered into a rest position guided by the profile of the cam 51 in known fashion. On the support plate 5 a cartridge 1, substantially C shaped as shown in dash-dot line, is placed, having the arms 1*c*–1*d* extended, flanking the type-carrying element S.

On the base of the cartridge 1 there are the pivots 1*a*–1*b* on which the spools 2 and 3 revolve, and unwinding the ribbon 20.

The ribbon is guided, starting from the spools 2 and 3 on the arms 1*c*–1*d* of the cartridge passing through narrow slits 22–23 of the wings 1*e*–1*f* of the cartridge 1 which are flexible at the point M of the cartridge, for example because of cuts or a like arrangement, in a known fashion. The cartridge 1 is mounted on the support plate 5 from above, and positioned by means of a stud 4 fixed to the support 5 and with the edges 1*g*–1*h* resting against the projections 5*a*–5*b* of the support 5 and thereby positioned so that the ribbon 20 passes between the type-carrying ball of spherical S, and the platen R as needed for the printing of the character.

Figure 3:
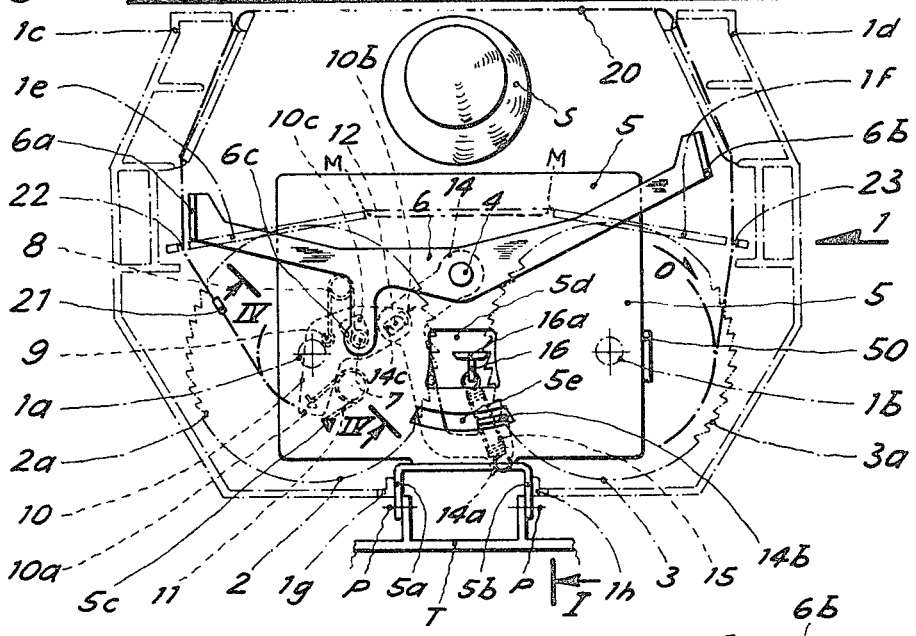
FIG. 3 is a lever of FIG. 2 shown with its associated parts from below.
Figure 3:
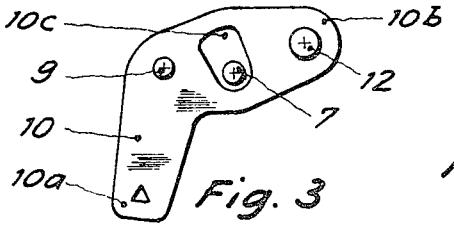
Figure 4:
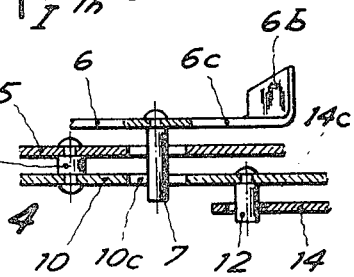
FIG. 4 is a scehmatic detail of the arrangement of two levers only, shown from a side and in section along a line IV—IV of FIG. 2.

On the stud 4 fixed to the support plate 5 a balance lever 6 is pivoted; this lever is fitted with two arms having paddle like extremities 6*a*–6*b* respectively in contact with the wings 1*e*–1*f* and a third arm 6*c* carrying a downward projection stud 7 (see also FIG. 4). On such stud 7 one extremity of a bistable spring 8 acts, while the other extremity rests against the pivot 9 rigidly mounted on the support plate 5. On such pivot 9 a lever 10 is hinged (see also FIG. 3 or FIG. 4). This lever has two arms 10*a*–10*b* and a window 10*c* shaped to clear the stud 7 rigidly connected to the lever 6 and allow the same a certain movement before coming in contact with the opposite sides of the same window, as will be explained below.

The extremity 10*a* of the lever 10 cooperates with one extremity of a bistable spring 11 (FIG. 2) whose other extremity rests against a fixed point 5*c* of the support 5.

The other extremity 10*b* of the lever 10 is fitted with a stud 12, projecting downward, which can slide for a certain amount within an elongated slot 14*c* of an intermediate lever 14 (FIG. 4) hinged on the fixed pivot 4. Said intermediate lever 14 also has an arm 14*a* and raised wing 14*b* passing with its upper edge through a curved slot 5*e* centered on the pivot 4 and cut in the support plate 5 in such a manner that the upper edge of the wing 14*b* (FIG. 1) finds itself facing the teeth 2*a*–3*a* of the spools 2 and 3.

Beneath said support plate 5 a driving lever 16 (FIGS. 1 and 3) is located, pointing downwards, laterally tiltable and hinged on a pivot 17 fixed to the machine frame, and having an arm 16*b* which is in contact with a cam 18 rigidly mounted on the driving shaft 19 and an arm 16*a* pointing upwards, which goes through an aperture 5*d* of the support plate 5 coming to face the teeth 2*a*–3*a* of the spools 2 and 3.

Between the driving lever 16 and the arm 14*a* of the intermediate lever 14 a spring 15 is placed, suitable to bring back the driving lever 16 actuated by the cam 18. The apertures 5*d*–5*e* are shaped so as to behave as stops for the extremities 16*a* and 14*b* of the levers 16 and 14 when the cartridge 1 is missing.

The upper part of the extremity 16*a*–14*b* of the levers 16 and 14 is cusp shaped and so are the extremities of the wings 6*a*–6*b* to make easier the insertion of the cartridge 1 on the support plate 5. The operation is as follows:

Under the driving action of the shaft 19 the cam 18 turns in the direction shown by arrow A and causes the oscillation of the lever 16 in the same direction, of the arrow A, this lever acting with its side part 16*a* on the teeth 3*a* of the spool 3 turns the latter in the clockwise direction pulling the ribbon which winds on this spool.

As the cam 18 continues its motion, the lever 16 comes back to the starting position under the action of the spring 15 which serves also to keep the part 16*a* of the driving lever 16 constantly in contact with the teeth 3*a* and to make it jump on them.

During the rotation of the spool 3 the wing 14*b* of the intermediate lever 14 jumps on the teeth 3*a* of the spool 3 under the action of the bistable spring 11 so that after each stepping movement opposite rotation is not permitted.

When almost all the ribbon is wound on the spool 3, continuing, as said, the feed of the ribbon the ring 21 eventually comes in contact with the wing 1*e* and, not being able to enter slot 22 it pulls with it the wing 1*e* and consequently the extremity 6*a* with which it is in contact, rotating in the clockwise direction the lever 6 connected to it, against the action of the bistable spring 8.

For about half of its pivotal movement the lever 6 does not play any role in the feed mechanism, since its stud 7 can slide freely in the widened slot 10*c* of the lever 10 but, beyond the dead center, the force of the same bistable spring 8 rotates the lever 6 causing, through the stud 7, which comes in contact with the widened slot 10*c*, the rotation of the lever 10 against the action of the second bistable spring 11, endowed with less force.

Such lever 10 with its stud 12 truns in the clockwise direction the lever 14 displaying its arm 14*a* to the left and pulling with it the spring 15.

It follows that the lever 16 will also be pulled by the spring 15 to the left and will rest against the teeth 2*a* of the spool 2 starting therefore to pull the same in the opposite directions so that the ribbon will now be wound in the direction opposite to the previous one until a new reversal of the same kind, now described, will occur. It is clear that several constructive varaints can be applied to what has been described and shown, without departing, for this reason, from the spirit and the scope of the invention.

We claim:

1. In a printing device having a platen, a type element juxtaposed with said platen and actuatable to imprint a character upon a paper disposed against said platen, a ribbon-feed mechanism for advancing a ribbon between said element and said device having a rotatable shaft, the improvement wherein said ribbon-feed mechanism comprises:

a ribbon cartridge, said cartridge including:

a cartridge housing formed with a pair of ribbon guides straddling said element, a pair of ribbon spools for unwinding and winding up a ribbon passing between said guides, said guides holding said ribbon between said element and said platen, said spools having toothed peripheries lying in a common plane, said housing having a bottom formed with a window between said toothed peripheries, a pair of deflectable wings traversed by said ribbon between each spool and a respective guide, and respective rings fixed to said ribbon toward opposite ends thereof whereby engagement of each ring with a respective one of said wings deflects the engaged wing outwardly;

a support plate pivotally mounted on said device for upward and downward rocking movement, said support plate being provided with means for positioning said cartridge thereon, whereby a rocking movement of said support plate lifts and lowers a stretch of said ribbon spanning said guide between said element and said platen;

a balance lever pivotally mounted on said support plate and having a pair of opposite arms each juxtaposed with one of said wings whereby, upon unwinding of ribbon from each spool, the engagement of a respective ring with a respective one of said wings deflects the same to swing said lever in a respective sense;

cam means on said shaft and cam follower means on said plate for alternately raising and lowering said plate;

a stepping pawl lever on said plate having a formation extending through said window and selectively directly engageable with the toothed peripheries of either of said spools, said stepping pawl lever being engageable with said cam means for stepping the toothed periphery of the spool with which it is engaged;

means including an intermediate lever connecting said balance lever with said stepping pawl lever for deflecting said stepping pawl lever from engagement with the toothed periphery of one of said spools into engagement with the toothed periphery of the other of said spools; and a formation on said intermediate lever engageable with said spools for preventing reverse rotation thereof during the stepping of each spool by said stepping pawl lever.

2. The improvement defined in claim 1 wherein said intermediate lever cooperates with a further lever having bistable positions and driven by said balance lever only upon the displacement of said balance lever through a predetermined lost motion.

3. The improvement defined in claim 1 wherein said support plate is formed with a plurality of apertures traversed by said formations.

4. The improvement defined in claim 1 wherein both of said formations have cusp-shaped ends facilitating the mounting of said cartridge on said plate.

* * * * *